US008815027B2

(12) United States Patent
Ishida et al.

(10) Patent No.: US 8,815,027 B2
(45) Date of Patent: Aug. 26, 2014

(54) FE-BASED SHAPE MEMORY ALLOY AND ITS PRODUCTION METHOD

(75) Inventors: Kiyohito Ishida, Sendai (JP); Ryosuke Kainuma, Natori (JP); Ikuo Ohnuma, Miyagi (JP); Toshihiro Omori, Sendai (JP); Keisuke Ando, Natori (JP)

(73) Assignee: Japan Science and Technology Agency, Kawaguchi-shi, Saitama (JP)

( * ) Notice: Subject to any disclaimer, the term of this patent is extended or adjusted under 35 U.S.C. 154(b) by 320 days.

(21) Appl. No.: 13/501,839

(22) PCT Filed: Oct. 6, 2010

(86) PCT No.: PCT/JP2010/067597

§ 371 (c)(1), (2), (4) Date: Apr. 13, 2012

(87) PCT Pub. No.: WO2011/046055

PCT Pub. Date: Apr. 21, 2011

(65) Prior Publication Data

US 2012/0199253 A1 Aug. 9, 2012

(30) Foreign Application Priority Data

Oct. 14, 2009 (JP) ..... 2009-237748

(51) Int. Cl.
*C22C 38/04* (2006.01)
*C22C 38/08* (2006.01)

(52) U.S. Cl.
CPC ..... *C22C 38/04* (2013.01); *C22C 38/08* (2013.01); *C21D 2201/01* (2013.01)
USPC ..... 148/402; 148/310; 420/73; 420/80

(58) Field of Classification Search
None
See application file for complete search history.

(56) References Cited

U.S. PATENT DOCUMENTS

| | | | | |
|---|---|---|---|---|
| 2008/0298999 | A1 | 12/2008 | Zak et al. | |
| 2009/0242083 | A1 | 10/2009 | Ishida et al. | |
| 2010/0156579 | A1 * | 6/2010 | Ishida et al. | 335/219 |

FOREIGN PATENT DOCUMENTS

| | | | | |
|---|---|---|---|---|
| JP | 62-170457 | A | | 7/1987 |
| JP | 63-223137 | A | | 9/1988 |
| JP | 01-055361 | A | * | 3/1989 |
| JP | 2000-017395 | A | | 1/2000 |
| JP | 2003-268501 | A | | 9/2003 |
| JP | 2009-503250 | A | | 1/2009 |
| WO | 2007/055155 | A1 | | 5/2007 |

* cited by examiner

*Primary Examiner* — George Wyszomierski
(74) *Attorney, Agent, or Firm* — Sughrue Mion, PLLC

(57) ABSTRACT

An Fe-based shape memory alloy comprising 25-42 atomic % of Mn, 12-18 atomic % of Al, and 5-12 atomic % of Ni, the balance being Fe and inevitable impurities, and an Fe-based shape memory alloy comprising 25-42 atomic % of Mn, 12-18 atomic % of Al, and 5-12 atomic % of Ni, as well as 15 atomic % or less in total of at least one selected from the group consisting of 0.1-5 atomic % of Si, 0.1-5 atomic % of Ti, 0.1-5 atomic % of V, 0.1-5 atomic % of Cr, 0.1-5 atomic % of Co, 0.1-5 atomic % of Cu, 0.1-5 atomic % of Mo, 0.1-5 atomic % of W, 0.001-1 atomic % of B and 0.001-1 atomic % of C, the balance being Fe and inevitable impurities.

20 Claims, 3 Drawing Sheets

FE-BASED SHAPE MEMORY ALLOY AND ITS PRODUCTION METHOD

CROSS REFERENCE TO RELATED APPLICATION

This application is a National Stage of International Application No. PCT/JP2010/067597, filed on Oct. 6, 2010, which claims priority from JP 2009-237748, filed Oct. 14, 2009, the contents of all of which are incorporated herein by reference in their entirety.

FIELD OF THE INVENTION

The present invention relates to an Fe-based shape memory alloy, particularly to an Fe-based shape memory alloy exhibiting excellent shape memory effect and hyperelasticity in a practical temperature range.

BACKGROUND OF THE INVENTION

Shape memory alloys are practically used to utilize their peculiar functions in various fields of industries, medicine, etc. Shape memory alloys exhibiting shape memory or hyperelasticity (also called "pseudoelasticity") phenomenon include non-ferrous alloys such as Ni—Ti alloys, Ni—Al alloys, Cu—Zn—Al alloys, Cu—Al—Ni alloys, etc., and iron alloys such as Fe—Ni—Co—Ti alloys, Fe—Mn—Si alloys, Fe—Ni—C alloys, Fe—Ni—Cr alloys, etc.

Ti—Ni alloys with excellent shape memory and hyperelasticity are practically used for medical guide wires, eyeglasses, etc. However, Ti—Ni alloys have limited applications because of poor workability and high cost.

Iron alloys advantageous in low material cost, magnetism, etc. would be expected to be used in various applications if more practical shape memory effects and hyperelasticity are obtained. However, iron-based shape memory alloys still suffer various unsolved problems. For example, Fe—Ni—Co—Ti alloys have shape memory characteristics by stress-induced transformation, but their Ms points (martensitic-transformation-starting temperatures) are as low as 200 K or lower. Fe—Ni—C alloys have poor shape memory characteristics because carbides are formed during reverse transformation. Despite better shape memory characteristics, Fe—Mn—Si alloys suffer poor cold workability and insufficient corrosion resistance, and exhibit no hyperelasticity.

JP 2000-17395 A discloses an Fe—Ni—Si shape memory alloy comprising 15-35% by weight of Ni, and 1.5-10% by weight of Si, the balance being Fe and inevitable impurities. JP 2003-268501 A discloses an Fe—Ni—Al shape memory alloy comprising 15-40% by mass of Ni, and 1.5-10% by mass of Al, the balance being Fe and inevitable impurities. These alloys contain a γ' phase having an $LI_2$ structure precipitated in a γ phase having an fcc structure. However, the shape memory effect and hyperelasticity of these alloys are not practically sufficient, their improvement being desired.

JP 62-170457 A discloses an iron-based shape memory alloy comprising 15-40% by weight of Mn, 1-20% by weight of Co and/or 1-20% by weight of Cr, and 15% or less by weight of at least one selected from Si, Al, Ge, Ga, Nb, V, Ti, Cu, Ni and Mn, the balance being iron. It describes that Co, Cr or Si extremely lowers a magnetic transformation point (Neel point), but does not substantially change a $\gamma \rightarrow \epsilon$ martensitic transformation point. However, this alloy has substantially no hyperelasticity and a practically insufficient shape memory effect, more improvement being desired.

OBJECT OF THE INVENTION

Accordingly, an object of the present invention is to provide an Fe-based shape memory alloy having excellent workability as well as excellent hyperelasticity and shape memory effect.

SUMMARY OF THE INVENTION

As a result of intense research in view of the above object, the inventors have found that the addition of particular amounts of Mn and Al to Fe provides an alloy having martensitic transformation, and that the further addition of Ni provides the alloy with shape memory characteristics. The present invention has been completed based on such findings.

Thus, an Fe-based shape memory alloy according to the present invention comprises 25-42 atomic % of Mn, 12-18 atomic % of Al, and 5-12 atomic % of Ni, the balance being Fe and inevitable impurities.

Another Fe-based shape memory alloy according to the present invention comprises 25-42 atomic % of Mn, 12-18 atomic % of Al, and 5-12 atomic % of Ni, as well as 15 atomic % or less in total of at least one selected from the group consisting of 0.1-5 atomic % of Si, 0.1-5 atomic % of Ti, 0.1-5 atomic % of V, 0.1-5 atomic % of Cr, 0.1-5 atomic % of Co, 0.1-5 atomic % of Cu, 0.1-5 atomic % of Mo, 0.1-5 atomic % of W, 0.001-1 atomic % of B and 0.001-1 atomic % of C, the balance being Fe and inevitable impurities.

The Fe-based shape memory alloy of the present invention is characterized in that its matrix has a bcc crystal structure, and that a phase having a B2 structure is precipitated in a matrix having an A2 structure.

The Fe-based shape memory alloy of the present invention preferably has a ferromagnetic matrix. The intensity of magnetization is preferably lower in the martensite phase than in the matrix.

In the Fe-based shape memory alloy of the present invention, the intensity of magnetization preferably changes reversibly depending on the amount of strain applied.

The method of the present invention for producing the Fe-based shape memory alloy comprises a solution treatment step at 1100-1300° C.

After said solution treatment step, an aging treatment step is preferably conducted at 100-350° C.

The wire of the present invention is formed by the Fe-based shape memory alloy having an average crystal grain size equal to or more than the radius of said wire.

The plate of the present invention is formed by the Fe-based shape memory alloy having an average crystal grain size equal to or more than the thickness of said plate.

BRIEF DESCRIPTION OF THE DRAWINGS

FIG. 3(*b*) is a schematic view showing another example of the sizes of crystal grains in the wire of the present invention.

DESCRIPTION OF THE PREFERRED EMBODIMENTS

[1] Fe-Based Shape Memory Alloy

Figure 1:
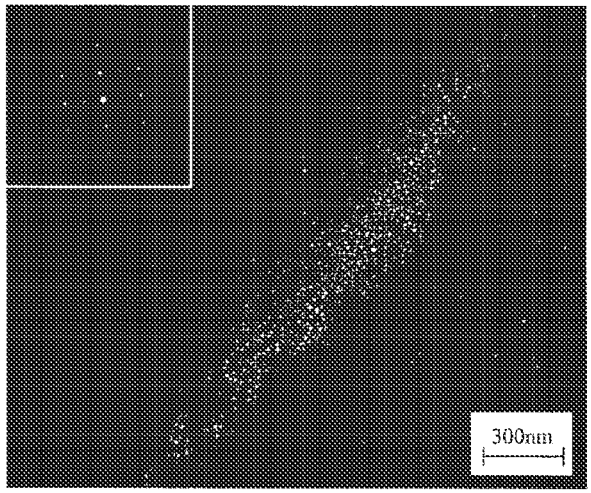
FIG. 1 is a transmission electron photomicrograph showing a dark-field image of a (100) plane of an Fe-based shape memory alloy (aged at 200° C. for 60 minutes) of No. 110 produced in Example 1.

Fe-based shape memory alloys according to embodiments of the present invention will be explained in detail below, and explanations of each embodiment will be applicable to other embodiments unless otherwise mentioned. The amount of each element is expressed herein based on the total amount (100 atomic %) of the alloy, unless otherwise mentioned.

(1) Composition

The first Fe-based shape memory alloy comprises 25-42 atomic % of Mn, 12-18 atomic % of Al, and 5-12 atomic % of Ni, the balance being Fe and inevitable impurities.

The second Fe-based shape memory alloy comprises 25-42 atomic % of Mn, 12-18 atomic % of Al, and 5-12 atomic % of Ni, as well as 15 atomic % or less in total of at least one selected from the group consisting of 0.1-5 atomic % of Si, 0.1-5 atomic % of Ti, 0.1-5 atomic % of V, 0.1-5 atomic % of Cr, 0.1-5 atomic % of Co, 0.1-5 atomic % of Cu, 0.1-5 atomic % of Mo, 0.1-5 atomic % of W, 0.001-1 atomic % of B and 0.001-1 atomic % of C, the balance being Fe and inevitable impurities.

Mn is an element accelerating the formation of a martensite phase. By adjusting the amount of Mn, it is possible to change the martensitic-transformation-starting temperature (Ms), martensitic-transformation-finishing temperature (Mf), reverse-martensitic-transformation-starting temperature (As), reverse-martensitic-transformation-finishing temperature (Af), and Curie temperature (Tc) of the alloy. When the amount of Mn is less than 25 atomic %, the bcc structure of the matrix is too stable, resulting in the likelihood that the martensitic transformation does not occur. When Mn is more than 42 atomic %, the matrix does not have a bcc structure. The amount of Mn is preferably 30-38 atomic %, more preferably 34-36 atomic %.

Al is an element accelerating the formation of a matrix having a bcc structure. When the amount of Al is less than 12 atomic %, the matrix has an fcc structure. When Al is more than 18 atomic %, the bcc structure is too stable to cause the martensitic transformation. The amount of Al is preferably 13-17 atomic %, more preferably 14-16 atomic %.

Ni is an element causing an ordered phase to precipitate in the matrix to improve the shape memory characteristics. Less than 5 atomic % of Ni does not provide sufficient shape memory characteristics, and more than 12 atomic % of Ni lowers the ductility of the alloy. The amount of Ni is preferably 5-10 atomic %, more preferably 6-8 atomic %.

Fe is an element improving the shape memory characteristics and magnetic properties. Insufficient Fe does not provide the shape memory characteristics, while excessive Fe fails to provide the shape memory characteristics. To have excellent shape memory characteristics and ferromagnetism, the amount of Fe is preferably 35-50 atomic %, more preferably 40-46 atomic %.

The addition of 15 atomic % or less in total of at least one element selected from the group consisting of Si, Ti, V, Cr, Co, Cu, Mo, W, B and C improves the shape memory characteristics, ductility and corrosion resistance of the alloy, and the adjustment of their amounts can change Ms and Tc. Co also acts to improve the magnetic properties. When the total amount of these elements exceeds 15 atomic %, the alloy likely becomes brittle. The total amount of these elements is preferably 10 atomic % or less, more preferably 6 atomic % or less. From the aspect of shape memory characteristics, it is preferably selected from the group consisting of Si, Ti, V, Cu, Mo, W, B and C.

(2) Structure

The first and second Fe-based shape memory alloys undergo martensitic transformation from a bcc-matrix (α-phase). Each alloy has a bcc matrix structure in a temperature range higher than Ms, and a martensitic structure in a temperature range lower than Mf. To exhibit excellent shape memory characteristics, the matrix is preferably an A2 phase having a disordered bcc structure in which fine ordered phases (B2 or $L2_1$) are precipitated, and the ordered phases are preferably B2 phases. Small amounts of γ-phases having a fcc structure may be precipitated in the matrix. The γ-phases are precipitated mainly in grain boundaries during cooling after the solution treatment or precipitated at a solution treatment temperature, improving the ductility. However, too much precipitation deteriorates the shape memory characteristics. When the γ-phases are precipitated in the matrix to improve the ductility, they are preferably 10% or less by volume, more preferably 5% or less by volume. The martensite phase has a long-period crystal structure of 2M, 8M, 10M, 14M, etc. The Fe-based shape memory alloy may be a single crystal having no crystal grain boundaries between α-phases.

The Fe-based shape memory alloy has a ferromagnetic bcc-matrix, and a martensite phase which is paramagnetic, antiferromagnetic, or less ferromagnetic than the matrix.

[2] Production Method

The Fe-based shape memory alloy can be produced by casting, forging, hot-working (hot-rolling, etc.), cold-working (cold-rolling, drawing, etc.), pressing, etc. to a desired shape, and a solution treatment. It can also be formed into a sintered body by powder sintering, or a thin film by rapid quenching, sputtering, etc. Casting, hot-working, sintering, film forming, etc. may be conducted by the same methods as in general shape memory alloys. Because of excellent workability, the Fe-based shape memory alloy can easily be formed into various shapes such as extremely thin wires, foils, etc. by cold-working, cutting, etc.

The production indispensably includes a solution treatment step. The solution treatment is conducted by heating an Fe-based shape memory alloy formed by casting, hot- and cold-working, etc. to a solution temperature to have a bcc matrix structure, and rapidly cooling it. The solution treatment is conducted preferably at 1100-1300° C., more preferably 1200-1250° C. Though a time period of keeping the solution temperature may be 1 minute or more, oxidation is not negligible when the keeping time is more than 60 minutes. Accordingly, the time period of keeping the solution temperature is preferably 1-60 minutes. The cooling speed is preferably 200° C./second or more, more preferably 500° C./second or more. The cooling is conducted by immersion in a coolant such as water, or by forced air cooling.

Though good shape memory characteristics can be obtained even only by a solution treatment, it is preferable to conduct an aging treatment at 100-350° C. after the solution treatment. The aging treatment is effective to improve and stabilize the shape memory characteristics. The aging temperature is more preferably 150-250° C. The aging time is preferably 5 minutes or more, more preferably 30 minutes to 24 hours, though variable depending on the composition of the Fe-based shape memory alloy and the treatment temperature. The aging time of less than 5 minutes fails to provide sufficient effects, and too long an aging treatment (for example, several hundreds hours) lowers the ductility of the alloy.

[3] Properties (1) Shape Memory Characteristics

Because the Fe-based shape memory alloy having higher As than a practical temperature range has a stable martensite phase in the practical temperature range, it stably exhibits good shape memory characteristics. The shape recovery ratio [=100×(given strain—residual strain)/given strain] of the Fe-based shape memory alloy is about 90% or more, substantially 100%.

(2) Hyperelasticity

The Fe-based shape memory alloy having lower Af than a practical temperature range exhibits stable and good hyperelasticity in the practical temperature range. Usually, the shape recovery ratio after removing deformation is 95% or more even at strain of 6-8%. While higher temperatures increase martensitic-transformation-induced stress in usual shape memory alloys, the Fe-based shape memory alloy of the present invention has small temperature dependence of the martensitic-transformation-induced stress, resulting in little deformation stress change by an ambient temperature, which is a practically preferable characteristic. While the temperature dependence of martensitic-transformation-induced stress is about 5 MPa/° C., for example, in Ni—Ti shape memory alloys, it is 2 MPa/° C. or less in the Fe-based shape memory alloy of the present invention. Small temperature dependence of transformation-induced stress appears to be due to the fact that transformation entropy change is small in the Fe-based shape memory alloy of the present invention.

(3) Workability

Because the Fe-based shape memory alloy of the present invention has good hardness, tensile strength and fracture elongation, it has excellent workability.

[4] Members of Fe-Based Shape Memory Alloy

Because the Fe-based shape memory alloy has high hot workability and cold workability and can be subject to cold working at the maximum working ratio of about 30-99%, it can easily be formed into extremely thin wires, foils, springs, pipes, etc.

Figure 3A:
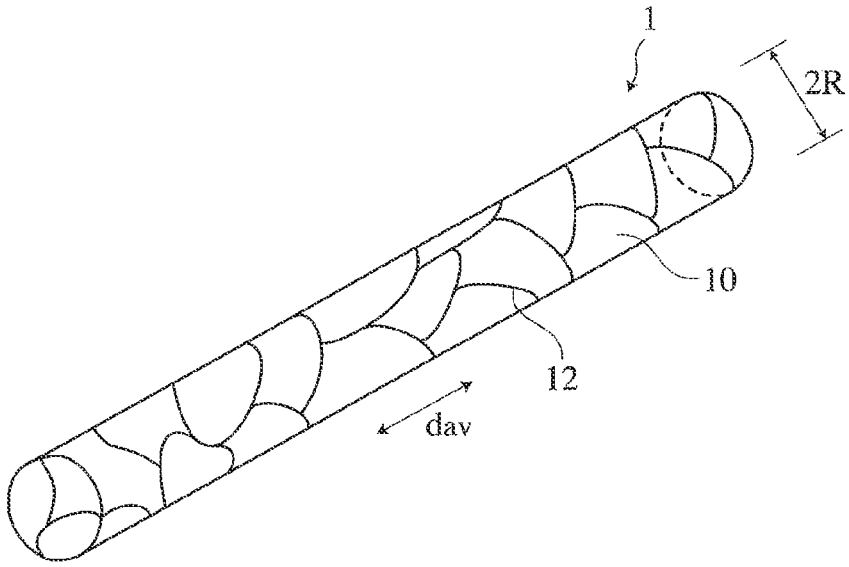
FIG. 3(*a*) is a schematic view showing one example of the sizes of crystal grains in the wire of the present invention.
Figure 3B:
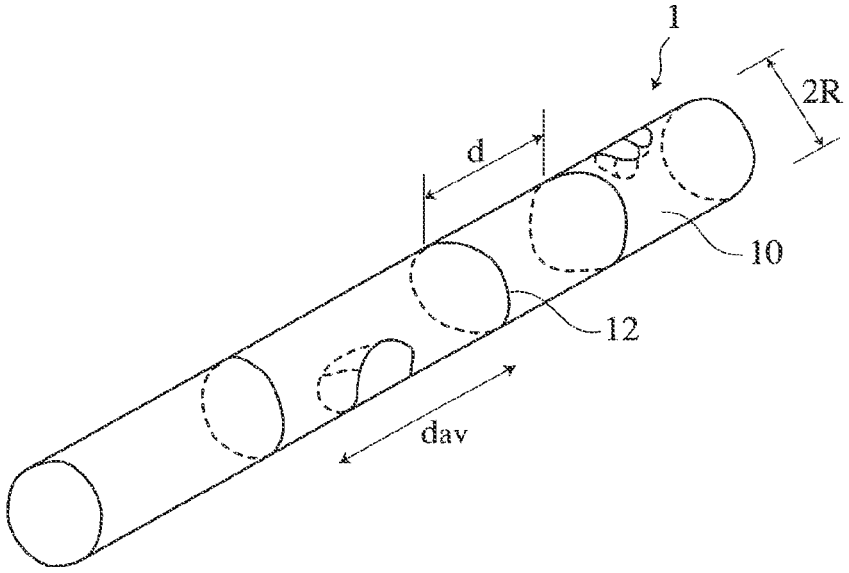

The shape memory characteristics of the Fe-based shape memory alloy largely depend not only on its crystal structure but also on the size of crystal grains. In the case of a wire or a plate, for example, an average crystal grain size equal to or more than the radius R of the wire or the thickness T of the plate results in largely improved shape memory effect and hyperelasticity. This appears to be due to the fact that when the average crystal grain size is equal to or more than the radius R of the wire or the thickness T of the plate as shown in FIGS. 3(*a*), 3(*b*) and 4, constraint forces between crystal grains are reduced.

(1) Wire

A wire 1 of the Fe-based shape memory alloy contains crystal grains 10 having an average crystal grain size day preferably equal to or more than the radius R of the wire 1, more preferably equal to or more than the diameter 2R. When the average crystal grain size day meets the condition of dav>2R, the wire 1 has a structure comprising grain boundaries 12 like bamboo joints, resulting in extremely reduced constraint between crystal grains, and thus resembling a single-crystal-like behavior.

Even though the condition of dav≥R or dav≥2R is met, the wire 1 contains crystal grains having particle sizes d less than the radius R, too, because of the particle size distribution of crystal grains. Though the existence of crystal grains having d<R in small amounts would not substantially affect the characteristics of the Fe-based shape memory alloy, regions having crystal grain sizes d equal to or more than the radius R are preferably 30% or more, more preferably 60% or more, of the entire length of the wire 1, to provide the Fe-based shape memory alloy with good shape memory effect and hyperelasticity.

The wire 1 can be used, for example, as guide wires for catheters. When the wire is as thin as 1 mm or less in diameter, plural wires may be stranded. Further, the wire 1 may be used for springs.

(2) Plate

Figure 4:
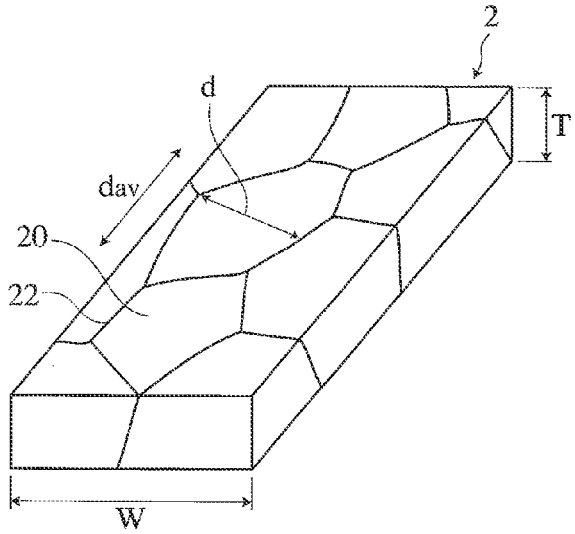
FIG. 4 is a schematic view showing one example of the sizes of crystal grains in the plate of the present invention.

A plate of the Fe-based shape memory alloy has, as shown in FIG. 4, an average crystal grain size dav of crystal grains 20 preferably equal to or more than the thickness T of the plate 1, more preferably dav≥2T. In the plate 2 having such crystal grains 20, individual crystal grains 20 are not constrained by grain boundaries 22 on a surface of the plate 2. The plate 2 meeting the condition of dav≥T has excellent shape memory effect and hyperelasticity like the above wire 1, because of low constraint forces between crystal grains. The average crystal grain size dav of crystal grains 20 is more preferably equal to or more than the width W of the plate 1.

Like the wire 1, even though the condition of dav≥T or dav≥2T is met, the plate 2 contains crystal grains having particle sizes d less than the thickness T, too, because of the particle size distribution of crystal grains. To provide the Fe-based shape memory alloy with better shape memory effect and hyperelasticity, regions having crystal grain sizes d equal to or more than the thickness T are preferably 30% or more, more preferably 60% or more, of the total area of the plate 2.

Utilizing its hyperelasticity, the plate 2 can be used for various springs, contact members, clips, etc.

(3) Production Method

The wires 1 can be produced by conducting hot forging and drawing to form relatively thick wires, cold working (maximum cold working ratio: 30% or more) such as cold-drawing in plural times to form thin wires 1, at least one solution treatment, and if necessary, hardening and aging.

The plates 2 can be produced by conducting hot rolling, cold rolling (maximum cold working ratio: 30% or more) in plural times, punching and/or pressing to a desired shape, at least one solution treatment, and if necessary, hardening and aging. Foils can be produced like the plates.

The present invention will be explained in further detail by Examples below without intention of restriction.

EXAMPLE 1

Solution-Treated Samples

Each Fe alloy having the composition shown in Table 1 was high-frequency-melted, cast, hot-rolled, and then cold-rolled to a plate thickness of 0.25 mm. The cold-rolled alloy was cut to a width of about 1 mm, solution-treated at 1200° C. for 30 minutes, and then hardened with water.

Aged Samples

Each of the above solution-treated samples was further subject to an aging treatment at 200° C. for 1 hour.

TABLE 1

| Alloy | Alloy Composition (atomic %) | | | |
|---|---|---|---|---|
| No. | Mn | Al | Ni | Fe |
| 101 | 30 | 14 | 5 | Balance |
| 102 | 33 | 14 | 5 | Balance |
| 103 | 36 | 15 | 5 | Balance |
| 104 | 40 | 16 | 5 | Balance |
| 105 | 32 | 14.5 | 6.5 | Balance |

TABLE 1-continued

| Alloy No. | Alloy Composition (atomic %) Mn | Al | Ni | Fe |
|---|---|---|---|---|
| 106 | 35 | 15 | 6.5 | Balance |
| 107 | 36 | 15 | 6.5 | Balance |
| 108 | 39 | 15.5 | 6.5 | Balance |
| 109 | 30 | 14.5 | 7.5 | Balance |
| 110 | 34 | 15 | 7.5 | Balance |
| 111 | 35 | 15 | 7.5 | Balance |
| 112 | 36 | 15 | 7.5 | Balance |
| 113 | 34 | 15 | 8 | Balance |
| 114 | 34 | 15.5 | 8 | Balance |
| 115 | 36 | 15 | 8 | Balance |
| 116 | 40 | 17 | 8 | Balance |
| 117 | 32 | 14.5 | 9 | Balance |
| 118 | 33 | 14.5 | 9 | Balance |
| 119 | 36 | 15 | 9 | Balance |
| 120 | 36 | 16 | 9 | Balance |
| 121 | 34 | 15 | 10 | Balance |
| 122 | 35 | 15.5 | 10 | Balance |
| 123 | 36 | 15 | 10 | Balance |
| 124 | 40 | 16.5 | 10 | Balance |
| 125 | 26 | 13.5 | 5 | Balance |
| 126* | 36 | 15 | — | Balance |
| 127* | 40 | 16 | 4 | Balance |
| 128* | 40 | 16 | 15 | Balance |
| 129* | 45 | 15 | 7.5 | Balance |
| 130* | 40 | 10 | 7.5 | Balance |
| 131* | 40 | 20 | 7.5 | Balance |

Note:
*Comparative Example.

Each of the solution-treated samples (solution-treated alloys) and the aged samples (solution-treated and aged alloys) was evaluated with respect to shape recovery characteristics. The shape recovery characteristics were evaluated by a shape recovery ratio (SME) by the shape memory effect on samples having a large percentage of martensite at room temperature, and by a shape recovery ratio (SE) by hyperelasticity on matrix-dominant samples. The results are shown in Table 2.

Shape Recovery Ratio (SME) by Shape Memory Effect

The shape memory effect was evaluated by a bending test. First, a test piece was wound around a round rod to have a surface strain of 2%. The surface strain $\epsilon$ was determined by the following formula:

$$\epsilon[\%]=(t/2r)\times 100 \quad (1),$$

wherein, t represents the thickness of the test piece, and r represents the radius of the round rod. The test piece with surface strain was heated at 700° C. for 3 seconds to cause shape recovery to determine the shape recovery ratio (SME) by the following formula:

$$\text{Shape recovery ratio } [\%]=[(\epsilon_1-\epsilon_2)/\epsilon_1]\times 100 \quad (2),$$

wherein $\epsilon_1$ represents a given surface strain, and $\epsilon_2$ represents a surface strain after heating.

Shape Recovery Ratio (SE) by Hyperelasticity

The hyperelasticity was evaluated by a tensile test. The shape recovery ratio (SE) was determined by the above formula (2), with $\epsilon_1$ changed to a strain (2%) given by the tensile test, and $\epsilon_2$ changed to a residual strain after removing the load.

TABLE 2

| Alloy No. | Solution-Treated Sample SME(1) (%) | SE(2) (%) | Aged Sample(1) SME (%) | SE (%) |
|---|---|---|---|---|
| 101 | — | 55 | — | 57 |
| 102 | — | 60 | — | 61 |
| 103 | — | 47 | — | 50 |
| 104 | 63 | — | 68 | — |
| 105 | — | 61 | — | 65 |
| 106 | — | 66 | — | 92 |
| 107 | — | 40 | — | 70 |
| 108 | 91 | — | 89 | — |
| 109 | — | 88 | — | 93 |
| 110 | — | 83 | — | 98 |
| 111 | — | 43 | — | 77 |
| 112 | 86 | — | 92 | — |
| 113 | 80 | — | 83 | — |
| 114 | — | 50 | — | 70 |
| 115 | 93 | — | 93 | — |
| 116 | — | 60 | — | 65 |
| 117 | — | 58 | — | 65 |
| 118 | 88 | — | 90 | — |
| 119 | 92 | — | 91 | — |
| 120 | — | 41 | — | 50 |
| 121 | — | 54 | — | 55 |
| 122 | — | 61 | — | 61 |
| 123 | 63 | — | 71 | — |
| 124 | — | 59 | — | 65 |
| 125 | — | 51 | — | 55 |
| 126* | — | 16 | — | 18 |
| 127* | 7 | — | 9 | — |
| 128* | — | — | — | — |
| 129* | — | — | — | — |
| 130* | — | — | — | — |
| 131* | — | — | — | — |

Note:
*Comparative Example.
(1)SME represents a shape recovery ratio by shape memory effect.
(2)SE represents a shape recovery ratio by hyperelasticity.

As is clear from Table 2, the Fe-based shape memory alloys (Nos. 101-125) of the present invention exhibited shape recovery ratios over 40% by the hyperelasticity or shape memory effect. It was found that the aging treatment substantially increased the shape recovery ratio, and better aging treatments provided more stable properties. On the other hand, the alloys (Nos. 126-131) of Comparative Examples exhibited only shape recovery ratios less than 20% for the reasons of no martensitic transformation, a large amount of an fcc-phase formed, and a large amount of β-Mn generated, etc.

EXAMPLE 2

Each Fe-based alloy was produced in the same manner as in Example 1, except for substituting part of Fe with the element (fifth component) shown in Table 3 in the composition of Alloy No. 110 produced in Example 1. The shape memory characteristics of these alloys by hyperelasticity were measured by the same method as in Example 1, and shown in Table 3.

TABLE 3

| Alloy No. | Amount of Fifth-Component Element (atomic %) | SE(1) (%) Solution-Treated Sample | Aged Sample |
|---|---|---|---|
| 201 | Si: 2 | 81 | 95 |
| 202 | Ti: 1 | 70 | 88 |
| 203 | V: 1 | 79 | 91 |
| 204 | Cr: 3 | 69 | 86 |
| 205 | Co: 2 | 61 | 81 |
| 206 | Mo: 1 | 74 | 93 |

TABLE 3-continued

| Alloy No. | Amount of Fifth-Component Element (atomic %) | SE[1] (%) Solution-Treated Sample | Aged Sample |
|---|---|---|---|
| 207 | W: 1 | 71 | 93 |
| 208 | B: 0.05 | 87 | 97 |
| 209 | C: 0.2 | 82 | 91 |

Note:
[1]SE represents a shape recovery ratio by hyperelasticity.

The Fe-based alloys having magnetic properties, corrosion resistance, strength, ductility, etc. improved by the addition of an element of Si, Ti, V, Cr, Co, Mo, W, B, C, etc. had excellent shape recovery ratios. Also, the aging treatment improved the hyperelasticity effect, resulting in as high a shape recovery ratio as 60% or more.

EXAMPLE 3

The magnetic properties of Fe-based alloys (Alloy Nos. 103, 107, 109, 110, 115, 119 and 123) produced in Example 1 were measured at room temperature by a vibrating sample magnetometer (VSM). Their intensities of magnetization at 1.5 T are shown in Table 4.

TABLE 4

| Alloy No. | Intensity of Magnetization (emu/g) Solution-Treated Sample | Aged Sample |
|---|---|---|
| 103 | 56 | 57 |
| 107 | 51 | 52 |
| 109 | 71 | 73 |
| 110 | 57 | 59 |
| 115 | 30 | 31 |
| 119 | 26 | 29 |
| 123 | 22 | 25 |

The matrix is dominant at room temperature in Alloy Nos. 103, 107, 109 and 110, and the martensite phase is dominant at room temperature in Alloy Nos. 115, 119 and 123. Table 4 indicates that the matrix is ferromagnetic, and that the martensite-dominant samples have smaller magnetization than that of the matrix. After these samples were cold-rolled by 50% to be completely martensitic, all samples had magnetization of 1 emu/g or less, indicating that the martensite phase was paramagnetic or antiferromagnetic.

Further, each of the solution-treated samples and aged samples of Alloy Nos. 201-209 produced in Example 2 was cold-rolled by 50% and evaluated with respect to magnetic properties. With each sample of about 0.25 mm×3 mm×3 mm put close to a Nd—Fe—B magnet of about 3 mm×10 mm×10 mm, the magnetic properties were evaluated as "Good" when the sample was attracted to the magnet and did not fall, and "Poor" when the sample fell without being attracted to the magnet. The results are shown in Table 5.

TABLE 5

| Alloy No. | Amount of Fifth-Component Element (atomic %) | Solution-Treated Sample | Solution Treatment + Cold Rolling | Aged Sample | Aging Treatment + Cold Rolling |
|---|---|---|---|---|---|
| 201 | Si: 2 | Good | Poor | Good | Poor |
| 202 | Ti: 1 | Good | Poor | Good | Poor |

TABLE 5-continued

| Alloy No. | Amount of Fifth-Component Element (atomic %) | Solution-Treated Sample | Solution Treatment + Cold Rolling | Aged Sample | Aging Treatment + Cold Rolling |
|---|---|---|---|---|---|
| 203 | V: 1 | Good | Poor | Good | Poor |
| 204 | Cr: 3 | Good | Poor | Good | Poor |
| 205 | Co: 2 | Good | Poor | Good | Poor |
| 206 | Mo: 1 | Good | Poor | Good | Poor |
| 207 | W: 1 | Good | Poor | Good | Poor |
| 208 | B: 0.05 | Good | Poor | Good | Poor |
| 209 | C: 0.2 | Good | Poor | Good | Poor |

Any matrix-state samples subject to the solution treatment or the solution treatment and the aging treatment were attracted to the magnet, indicating that they were ferromagnetic. However, the samples cold-rolled to be martensitic were not attracted to the magnet, indicating that they were paramagnetic, antiferromagnetic or slightly ferromagnetic.

EXAMPLE 4

Each alloy was produced in the same manner as the solution-treated alloy (Alloy No. 110) of Example 1 except for changing the temperature and time of the solution treatment as shown in Table 6, and its shape memory characteristics (shape recovery ratio by hyperelasticity) were measured. The results are shown in Table 6.

TABLE 6

| Solution Treatment (° C.) | (minutes) | SE (%) |
|---|---|---|
| 1050 | 60 | 10 |
| 1100 | 60 | 32 |
| 1150 | 60 | 43 |
| 1200 | 30 | 83 |
| 1250 | 30 | 81 |
| 1300 | 15 | 84 |
| 1350 | 15 | —[1] |

Note:
[1]With a liquid phase appearing, the alloy was partially melted.

The samples solution-treated at 1100-1300° C. exhibited a shape recovery effect, but those solution-treated at 1350° C. were partially melted with a liquid phase because the solution treatment temperature was too high. When solution-treated at 1100° C. and 1150° C., a trace amount of an fcc phase, if any, was precipitated in the bcc-matrix, resulting in improved ductility with little deterioration of characteristics. On the other hand, when heat-treated at 1050° C., a large amount of the fcc-phase was precipitated because of low temperature, exhibiting substantially no shape recovery. These facts indicate that the solution treatment temperature is preferably 1100-1300° C.

EXAMPLE 5

Each alloy was produced in the same manner as the aged sample (Alloy No. 110) of Example 1 except for changing the temperature and time of the aging treatment as shown in Table 7, and its shape memory characteristics (shape recovery ratio by hyperelasticity) were measured. The results are shown in Table 7 together with those of a sample without aging (solution-treated sample of Alloy No. 110).

TABLE 7

| Aging Treatment Conditions | | |
|---|---|---|
| (° C.) | (minutes) | SE (%) |
| No Aging Treatment | | 83 |
| 100 | 60 | 89 |
| 150 | 60 | 91 |
| 200 | 60 | 98 |
| 250 | 60 | 98 |
| 300 | 15 | 96 |
| 350 | 5 | 94 |
| 400 | 15 | —(1) |

Note:
(1)Broken by strain of 1%.

Table 7 indicates that aging at 100-350° C. after the solution treatment provides good shape memory characteristics. A dark-field image of a (100) plane of the B2 ordered phase in the sample aged at 200° C. for 60 minutes, which was measured by TEM, is shown in FIG. 1, an upper left portion of which shows a diffraction image of the bcc-matrix (or B2 precipitates) obtained in [01-1]. The the B2 phase is indicated by white dots in the dark-field image of FIG. 1. It is clear from FIG. 1 that fine B2 phases are precipitated in the A2 matrix. X-ray diffraction measurement confirmed that any alloys (Alloy Nos. 101-125) had such a structure of A2+B2. On the other hand, when the aging temperature was as high as 400° C., β-Mn was precipitated, making the alloy so brittle that it was broken by strain of about 1%. These facts indicate that the aging temperature is preferably 100-350° C.

EXAMPLE 6

An alloy produced in the same manner as the aged alloy (Alloy No. 110) of Example 1 except for changing the aging time to 6 hours was evaluated with respect to shape memory characteristics at each temperature of −60° C., 20° C. and 50° C. The shape memory characteristics were evaluated by a shape recovery ratio by hyperelasticity by the same method as in Example 1 except for changing the test temperature. The results are shown in Table 8 and FIG. 2. The martensitic-transformation-induced stress was stress reaching a stress plateau.

TABLE 8

| Test Temperature (° C.) | Martensite-Induced Stress (MPa) | SE (%) |
|---|---|---|
| −60 | 319 | 100 |
| 20 | 350 | 93 |
| 50 | 368 | 92 |

Figure 2:
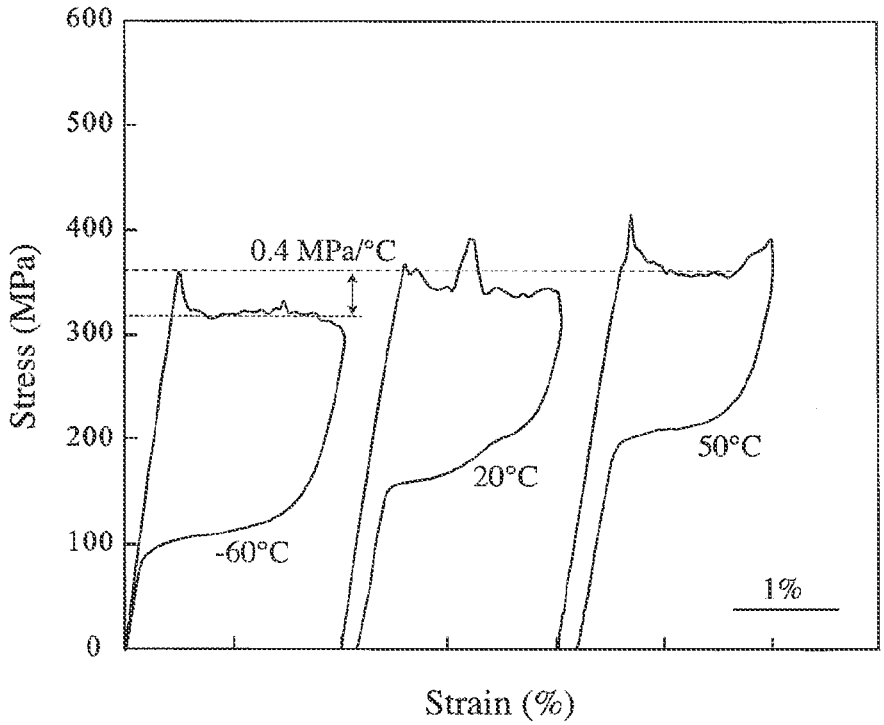
FIG. 2 is a graph showing stress-strain curves at −60° C., 20° C. and 50° C. of the Fe-based shape memory alloy of No. 110 produced in Example 1.

As is clear from Table 8 and FIG. 2, the shape recovery ratio did not depend on the test temperature, extremely high at any temperatures. The martensitic-transformation-induced stress similarly did not change largely depending on the temperature. In usual shape memory alloys, the martensitic-transformation-induced stress largely changes depending on the temperature; in a Ti—Ni shape memory alloy, for example, the dependence of the martensitic-transformation-induced stress on temperature is as large as about 5 MPa/° C. On the other hand, the Fe-based shape memory alloy of the present invention suffered extremely small change of stress depending on the temperature, as is clear from the stress-strain diagram of FIG. 2, exhibiting the temperature dependence of martensitic-transformation-induced stress of about 0.4 MPa/° C., about 1/10 of that of the Ti—Ni alloy. It is thus clear that the Fe-based shape memory alloy of the present invention has strength less influenced by the temperature in a wide temperature range from below room temperature to high temperatures.

EXAMPLE 7

Fe alloys of Nos. 301-310 having the compositions shown in Table 9 were produced in the same manner as in Example 1 except for changing the thickness of the plate and the total time of the solution treatment. Table 9 indicates that for example, Alloy No. 301 had the same composition as that of Alloy No. 208 (Example 2). Crystal grain sizes were adjusted by changing the total time of the solution treatment. These alloys had dav/t (ratio of average crystal grain size dav to plate thickness t) shown in Table 9. The average crystal grain size dav was determined by measuring the sizes (maximum crystal lengths) of 5-50 crystal grains observed by an optical microscope and averaging them. The shape memory characteristics [shape recovery ratios (SE) by hyperelasticity] of these alloys were measured in the same manner as in Example 1 except for changing the strain to 4%, and evaluated as "Poor" when the shape recovery ratio was less than 50%, "Good" when it was 50% or more and less than 75%, and "Excellent" when it was 75% or more. The results are shown in Table 9.

TABLE 9

| | | | SE (%) | |
|---|---|---|---|---|
| Alloy No. | Alloy Composition | dav/t(1) | Solution-Treated Sample | Aged Sample |
| 301 | No. 208 | 0.1 | Poor | Poor |
| 302 | No. 110 | 0.4 | Poor | Poor |
| 303 | No. 106 | 0.5 | Poor | Poor |
| 304 | No. 110 | 1.0 | Good | Good |
| 305 | No. 114 | 1.5 | Good | Good |
| 306 | No. 201 | 2.5 | Good | Good |
| 307 | No. 110 | 3.2 | Good | Good |
| 308 | No. 106 | 4.8 | Good | Excellent |
| 309 | No. 110 | 7.6 | Good | Excellent |
| 310 | No. 110 | 14.8 | Good | Excellent |

Note:
(1)dav represents the average crystal grain size, and t represents the thickness of the plate.

It is clear from Table 9 that the larger the dav/t, the higher the hyperelasticity; particularly dav/t of 1 or more provided excellent hyperelasticity.

EXAMPLE 8

Fe alloys having the compositions shown in Table 10 were high-frequency-melted, cast, hot-rolled by a grooved roll, and cold-drawn to produce wires of Nos. 401-408. These wires were solution-treated at 1200° C., and then aged at 200° C. for 1 hour. Crystal grain sizes were adjusted by changing the total time of the solution treatment. These wires had dav/R (ratio of average crystal grain size dav to radius R) shown in Table 10. The average crystal grain size dav was determined by measuring the sizes (maximum crystal lengths) of 5-50 crystal grains observed by an optical microscope, and averaging them. The shape memory characteristics evaluated were shape recovery ratios by hyperelasticity as in Example 7. The results are shown in Table 10.

TABLE 10

| Alloy No. | Alloy Composition | dav/R[1] | SE (%) Solution-Treated Sample | SE (%) Aged Sample |
|---|---|---|---|---|
| 401 | No. 208 | 0.1 | Poor | Poor |
| 402 | No. 114 | 0.2 | Poor | Poor |
| 403 | No. 106 | 0.5 | Good | Good |
| 404 | No. 110 | 1.2 | Good | Excellent |
| 405 | No. 201 | 2.7 | Good | Excellent |
| 406 | No. 106 | 4.1 | Good | Excellent |
| 407 | No. 110 | 8.5 | Good | Excellent |
| 408 | No. 110 | 11.1 | Good | Excellent |

Note:
[1]dav represents the average crystal grain size, and R represents the radius of a wire.

The dav/R of 0.5 or more provided high hyperelasticity, and the dav/R of 1 or more provided higher hyperelasticity. It was found that the larger the dav/R, the higher the shape memory characteristics.

EXAMPLE 9

Figure 5:
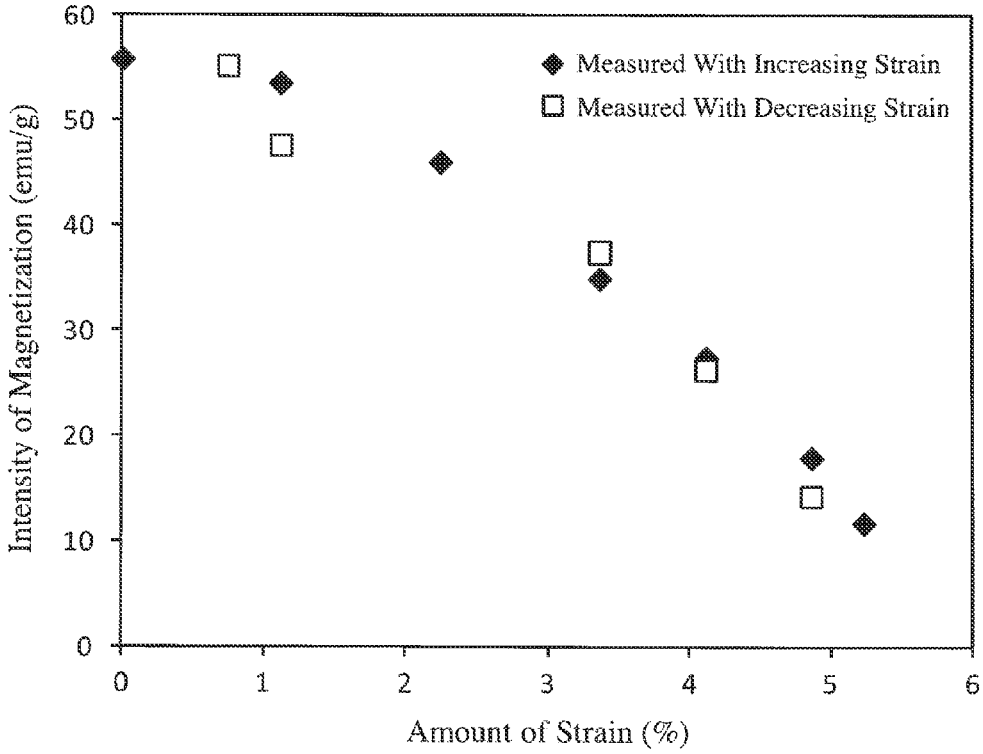
FIG. 5 is a graph showing the magnetic properties of the Fe-based alloy of the present invention under tensile strain.

The Fe-based alloy (Alloy No. 110) produced in Example 1 was evaluated at room temperature with respect to magnetic properties under tensile strain by a vibrating sample magnetometer (VSM). The magnetization was measured first without strain, and then with an increasing amount of strain, and finally with decreasing amount of strain. FIG. 5 shows the relation between the amount of strain and the intensity of magnetization at 0.5 T.

At room temperature, the matrix-dominant, Fe-based alloy (Alloy No. 110) was ferromagnetic without tensile strain, exhibiting large magnetization, but the application of tensile strain induced an antiferromagnetic martensite phase, resulting in magnetization decreasing as the strain increased. While decreasing strain, the amount of martensite decreased by hyperelasticity, resulting in increased magnetization. Thus, because the deformation and magnetization change reversibly, the Fe-based alloy of the present invention can be used for sensors.

EFFECT OF THE INVENTION

Because the Fe-based shape memory alloy of the present invention has a relatively low material cost, excellent workability, and high shape memory effect and hyperelasticity, it can be used in various applications for various purposes.

What is claimed is:

1. An Fe-based shape memory alloy comprising 25-42 atomic % of Mn, 12-18 atomic % of Al, and 5-12 atomic % of Ni, the balance being Fe and inevitable impurities.

2. The Fe-based shape memory alloy according to claim 1, wherein its matrix has a bcc crystal structure.

3. The Fe-based shape memory alloy according to claim 2, wherein a phase having a B2 structure is precipitated in a matrix having an A2 structure.

4. The Fe-based shape memory alloy according to claim 1, wherein its matrix is ferromagnetic.

5. The Fe-based shape memory alloy according to claim 1, comprising a martensite phase and a matrix, wherein the intensity of magnetization is lower in the martensite phase than in the matrix.

6. The Fe-based shape memory alloy according to claim 1, wherein the intensity of magnetization changes reversibly in response to an amount of strain applied.

7. A method for producing the Fe-based shape memory alloy recited in claim 1, comprising a solution treatment step at 1100-1300° C.

8. The method for producing an Fe-based shape memory alloy according to claim 7, comprising an aging treatment step at 100-350° C. after the solution treatment step.

9. A wire formed by the Fe-based shape memory alloy recited in claim 1, wherein said Fe-based shape memory alloy has an average crystal grain size equal to or more than the radius of said wire.

10. A plate formed by the Fe-based shape memory alloy recited in claim 1, said Fe-based shape memory alloy having an average crystal grain size equal to or more than the thickness of said plate.

11. An Fe-based shape memory alloy comprising 25-42 atomic % of Mn, 12-18 atomic % of Al, and 5-12 atomic % of Ni, as well as 15 atomic % or less in total of at least one selected from the group consisting of 0.1-5 atomic % of Si, 0.1-5 atomic % of Ti, 0.1-5 atomic % of V, 0.1-5 atomic % of Cr, 0.1-5 atomic % of Co, 0.1-5 atomic % of Cu, 0.1-5 atomic % of Mo, 0.1-5 atomic % of W, 0.001-1 atomic % of B and 0.001-1 atomic % of C, the balance being Fe and inevitable impurities.

12. The Fe-based shape memory alloy according to claim 11, wherein its matrix has a bcc crystal structure.

13. The Fe-based shape memory alloy according to claim 12, wherein a phase having a B2 structure is precipitated in a matrix having an A2 structure.

14. The Fe-based shape memory alloy according to claim 11, wherein its matrix is ferromagnetic.

15. The Fe-based shape memory alloy according to claim 11, comprising a martensite phase and a matrix, wherein the intensity of magnetization is lower in the martensite phase than in the matrix.

16. The Fe-based shape memory alloy according to claim 11, wherein the intensity of magnetization changes reversibly in response to an amount of strain applied.

17. A method for producing the Fe-based shape memory alloy recited in claim 11, comprising a solution treatment step at 1100-1300° C.

18. The method for producing an Fe-based shape memory alloy according to claim 17, comprising an aging treatment step at 100-350° C. after the solution treatment step.

19. A wire formed by the Fe-based shape memory alloy recited in claim 11, wherein said Fe-based shape memory alloy has an average crystal grain size equal to or more than the radius of said wire.

20. A plate formed by the Fe-based shape memory alloy recited in claim 11, said Fe-based shape memory alloy having an average crystal grain size equal to or more than the thickness of said plate.

* * * * *